US006812195B2

(12) United States Patent
Wierenga et al.

(10) Patent No.: US 6,812,195 B2
(45) Date of Patent: Nov. 2, 2004

(54) CONCENTRATED DETERGENT COMPOSITIONS WITH STABLE SUDSING CHARACTERISTICS

(75) Inventors: Thomas James Wierenga, Cincinnati, OH (US); James August Weikel, Fairfield, OH (US)

(73) Assignee: The Procter & Gamble Co., Cincinnati, OH (US)

( * ) Notice: Subject to any disclaimer, the term of this patent is extended or adjusted under 35 U.S.C. 154(b) by 0 days.

(21) Appl. No.: 10/244,304

(22) Filed: Sep. 16, 2002

(65) Prior Publication Data

US 2003/0114329 A1 Jun. 19, 2003

Related U.S. Application Data

(60) Provisional application No. 60/323,471, filed on Sep. 18, 2001.

(51) Int. Cl.[7] ..... C11D 17/00

(52) U.S. Cl. ..... 510/220; 510/223; 510/225; 510/228; 510/229; 510/233

(58) Field of Search ..... 510/220, 223, 510/225, 228, 229, 233

(56) References Cited

U.S. PATENT DOCUMENTS 5,158,710 A * 10/1992 VanEenam ..... 510/264
6,362,147 B1 * 3/2002 Castro et al. ..... 510/235

* cited by examiner

*Primary Examiner*—Necholus Ogden
(74) *Attorney, Agent, or Firm*—Theodore P. Cummings; S. Robert Chuey

(57) ABSTRACT

The present invention is directed to a grease-cutting detergent composition that exhibits a stable foaming profile when used with non-enclosed automatic dishwashers. The composition can be sold in a concentrated form or in ready-to-use (RTU) diluted form. The concentrated compositions are formulated to be diluted with water before use. The RTU formulas are intended for as-is usage. In one embodiment the concentrated compositions comprises a) from about 0.25% to about 10% of a surfactant, b) from about 4% to about 8% of an alkalinity source, c) from about 0.1% to about 4.0% of a hydrotrope, d) from about 0.001% to about 2.0% of a builder, and e) from about 0.01% to about 3.0% of a thickener. In another embodiment an RTU formulation comprises a) from about 50 ppm to about 80 ppm of a surfactant, b) from about 45 ppm to about 75 ppm of an alkalinity source, c) from about 20 ppm to about 45 ppm of a hydrotrope, d) from about 0.1 ppm to about 5 ppm of a builder, and e) from about 5 ppm to about 18 ppm of a thickener. The concentrated compositions have a pH of from about 12 to about 13, preferably from about 12.40 to about 12.60, and most preferably from about 12.45 to about 12.55. The concentrated compositions preferably are diluted by the end user at a ratio of from about 1:700 to about 1:1100 parts cleaning composition to water, more preferably from about 1.800 to about 1:1000 parts cleaning composition to water. The present invention also relates to methods of preparing and using the detergent compositions

17 Claims, No Drawings

CONCENTRATED DETERGENT COMPOSITIONS WITH STABLE SUDSING CHARACTERISTICS

CROSS REFERENCE TO RELATED APPLICATIONS

This application claims priority to U.S. Provisional Application No. 60/323,471, filed Sep. 18, 2001.

FIELD OF THE INVENTION

The present invention relates to grease-cutting detergent compositions with a stable sudsing profile. More specifically, this invention relates to grease-cutting detergent compositions suitable for use in non-enclosed automatic dishwashers.

BACKGROUND OF THE INVENTION

The food service industry has historically been plagued with very high rates of employee turnover. This has resulted in food service establishments being frequently unable to meet their full staffing requirements. In such an environment it is critical that the limited number of employees be able to focus on high value added tasks, such as food preparation and customer service, and not be tied to simple, but nonetheless important, tasks such as dish and utensil cleaning.

In response to this dilemma, food service equipment manufacturers have developed a variety of systems that allow food service operators to save both time and money by reducing the traditional amount of employee involvement in certain cleaning tasks. One such example is the development of non-enclosed automatic dishwashing machines.

These non-enclosed automatic dishwashers may comprise one or more tubs. Typically, at least one tub is provided for washing of the pots, pans and utensils. Additional tubs for rinsing and sanitizing are generally also provided. In operation the soiled pots, pans and utensils are placed in a prepared washtub. Then a recirculating pump, attached to the washtub, is activated. The recirculating pump allows the wash solution (i.e., water and detergent) to be repeatedly recycled over the soiled utensils. The recirculation provides agitation comparable to hand washing, and after some period of time, typically one to four hours, the utensils are clean and ready for rinsing and sanitation. Employee involvement in the cleaning process is thereby reduced to placing the soiled utensils in the prepared washtub, and removing the clean utensils some time thereafter. Examples of such non-enclosed automatic dishwashers for pot & pan and utensils include the Turbowash II® sink, manufactured and sold by the Hobart Corporation of Troy, Ohio; and the Powersoak® sink, manufactured and sold by Metcraft Incorporated of Grandview, Mo.

Use of these time, labor and cost saving devices, however, is not without its obstacles. Conventional detergent formulations of the type typically used in the hand washing of pots, pans and utensils exhibit numerous deficiencies when used in combination with the non-enclosed automatic dishwashers described herein. Most notable of these deficiencies is the tendency to produce copious and uncontrolled amounts of foam when subjected to the constant agitation of the recirculating pump. After only a short period of time the agitation induced suds overflow the confines of the washtub, spilling out onto the floor. This creates potential safety hazards that require immediate redress, thereby preventing an employee from focusing on other high value added tasks such as customer service.

Equally ill-suited for use in the non-enclosed automatic dishwashers described herein are currently available automatic dish washing detergent compositions of the type used in enclosed automatic dishwashing devices. When used in conjunction with non-enclosed automatic dishwashers these compositions produce minimal to no foam. Though this alleviates the problem of suds overflow, users disprefer these formulations.

It has been found that that the perceived efficacy of any given detergent composition by a consumer is based in part on the visually perceptible presence of suds. Detergents in such applications that do not, or no longer, produce suds are frequently thought of as not having the required or desired cleaning capabilities, regardless of the actual cleaning capabilities remaining. This results in higher material usage costs as users empty non-foaming wash solutions even though the solution continues to be effective.

It has also been found that use of non-foaming automatic dishwashing detergents (e.g. of the type used in enclosed automatic dishwashers) results in the need for more frequent cleaning and maintenance of a facilities ventilation system.

The constant mechanical agitation of the non-enclosed automatic dishwashers described above has the tendency to produce large volumes of atomized grease particles, as compared to hand washing. In the absence of a foam/suds layer at the surface of the water in the washtub, these atomized grease particles become airborne and are removed via the operator's ventilation system. This requires more frequent cleaning of the ventilation filtration system, and a corresponding increase in labor costs.

Accordingly, it is an object of the present invention to provide detergent compositions which exhibit a stable sudsing profile over time, thereby providing the consumer confidence in the efficacy of the detergent's cleaning capabilities. It is another object of the present invention to provide a detergent composition for use in non-enclosed automatic dishwashing devices that inhibit the airborne release of atomized grease particles.

It is yet another object of the present invention to provide a detergent formulation with good grease cutting capability that will remain stable and/or constant over the duration of the wash cycle.

SUMMARY OF THE INVENTION

The present invention is directed to a grease-cutting detergent composition that exhibits a stable foaming profile when used with non-enclosed automatic dishwashers. The composition can be sold in a concentrated form or in ready-to-use (RTU) diluted form. The concentrated compositions are formulated to be diluted with water before use. The RTU formulas are intended to be used as-is.

In one embodiment the concentrated compositions comprise a) from about 0.25% to about 10% of a surfactant, b) from about 4% to about 8% of an alkalinity source, c) from about 0.1% to about 4.0% of a hydrotrope, d) from about 0.001% to about 2.0% of a builder, and e) from about 0.01% to about 3.0% of a thickener. In another embodiment an RTU formulation comprises a) from about 50 ppm to about 80 ppm of a surfactant, b) from about 45 ppm to about 75 ppm of an alkalinity source, c) from about 20 ppm to about 45 ppm of a hydrotrope, d) from about 0.1 ppm to about 5 ppm of a builder, and e) from about 5 ppm to about 18 ppm of a thickener.

The concentrated compositions have a pH of from about 12 to about 13, preferably from about 12.40 to about 12.60, and most preferably from about 12.45 to about 12.55. The concentrated compositions preferably are diluted by the end user at a ratio of from about 1:700 to about 1:1100 parts cleaning composition to water, more preferably from about 1:800 to about 1:1000 parts cleaning composition to water.

The present invention also relates to methods of preparing and using the detergent compositions

DETAILED DESCRIPTION OF THE INVENTION

I. Definitions

As used herein, the terms "foam," "foaming," "suds," and "sudsing" are meant to be synonymous and are defined as a mass of bubbles of air or gas in a matrix of liquid film, especially an accumulation of bubbles formed in or on the surface of a liquid.

Publications and patents are referred to throughout this disclosure. All references cited herein are hereby incorporated by reference.

All percentages and ratios are calculated by weight unless otherwise indicated. All percentages and ratios are calculated based on the total composition unless otherwise indicated.

As used herein, and unless otherwise indicated, the use of a numeric range to indicate the value of a given variable is not intended to be limited to just that stated range. One of ordinary skill in the art will appreciate that the use of a numeric range to indicate the value of a variable is meant to include not just the values bounding the stated range, but also all values and sub-ranges contained therein. By way of example, consider variable X, which is disclosed as having a value in the range of 1 to 5. One of ordinary skill in the art will understand that variable X is meant to include all integer and non-integer values bound the by the stated range (e.g., 2, 3, 4, 1.1, 3.00756, 4.39, and the like). Moreover, one of ordinary skill in the art will appreciate that the value of the variable also includes all combinations and/or permutations of sub-ranges bounded by the integer and non-integer values (e.g., 1–4, 1–3, 1–2, 1.0004–4.34564, 3.4–5, and the like).

All component or composition levels are in reference to the active level of that component or composition, and are exclusive of impurities, for example, residual solvents or by-products, which may be present in commercially available sources.

As used herein, the total amount of any given component includes any added component as well as any of the components inherently present in the composition by virtue of inclusion of additional ingredients in the composition.

Referred to herein are trade names for components including various ingredients utilized in the present invention. The inventors herein do not intend to be limited by materials under a certain trade name. Equivalent materials (e.g., those obtained from a different source under a different name or catalog number) to those referenced to by trade name may be substituted and utilized in the compositions, kits, and methods herein.

In the description of the invention various embodiments and/or individual features are disclosed. As will be apparent to the ordinarily skilled practitioner, all combinations of such embodiments and features are possible and can result in preferred executions of the present invention.

II. Ingredients

A. Surfactants

The detergent compositions of the present invention comprise one or more surfactants. Suitable surfactants for use in the present invention should be relatively insensitive to water hardness, by which is meant that the surfactant will remain effective, either by itself or in combination with the prescribed amount of builder, when used (e.g., diluted or prepared) with water of a hardness of from about 1 grain/gallon to about 30 grains/gallon.

Additionally, suitable surfactants for inclusion in the compositions of the present invention will exhibit a stable sudsing profile when subjected to fatty acid grease in combination with the mechanical agitation of the non-enclosed automatic dishwashers of the type described herein. A suitable sudsing profile is defined herein as having a foam height within the ranges set forth in Table 1.

TABLE 1

| mls of Grease Added | 0 | 50 | 75 | 100 | 125 | 150 | 175 | 200 |
|---|---|---|---|---|---|---|---|---|
| Foam Height | 2.0"–6.0" | 0.5"–1.5" | 0.75"–1.00" | 0.5"–0.75" | 0.5"–0.75" | 0.5"–0.75" | 0.25"–0.6" | 0.25"–0.6" |

Foam height is determined according to the following test protocol:

Test Protocol

A 60-gallon washtub of a non-enclosed automatic dishwasher of the type described herein is filled with water at 115° F. The concentrated cleaner is added and mixed for 10 minutes with the pump on. Twenty-five milliliters (25 ml) of fatty acid grease is then poured into the sink every 30 minutes. Before each addition of grease the suds-height is measured using a core sampling procedure.

Suitable surfactants are those that have the desired effectiveness in the presence of water with varying degrees of hardness and exhibit the prescribed foaming characteristics under the stated conditions. Sodium paraffin sulfonate is a particularly preferred surfactant for the detergent compositions of the present invention.

In diluted or RTU formulations the surfactant should be present in a range of from about 50 ppm to about 80 ppm, preferably from about 55 ppm to about 75 ppm, more preferably from about 60 ppm to about 70 ppm.

B. Alkalinity Source

The detergent compositions of the present invention additionally comprise an alkalinity source that, in combination with the selected surfactant, aides in the removal of grease. Preferred alkalinity sources are determined by the form of the final detergent composition (e.g., concentrated or RTU). Detergent compositions, both concentrated and RTU, preferably have alkalinity sources that will not precipitate and clog the respective detergent dispensing apparatuses.

Suitable alkalinity sources will provide a pH for a concentrated detergent composition in the range of from about 9 to about 13, preferably from about 10.5 to about 13, most preferably from about 11.5 to about 12.6. Suitable alkalinity sources will provide a pH for a RTU or diluted detergent composition in the range of from about 7 to about 11, preferably from about 8 to about 11, most preferably from about 9 to about 10.

Preferred alkalinity sources are selected from the group consisting of sodium carbonate, sodium metasilicate, 2-amino-2methyl-1-propanol, sodium hydroxide, and mixtures thereof. Particularly preferred alkalinity sources are selected from the group consisting of 2-amino-2methyl-1-propanol, sodium hydroxide, and mixtures thereof.

C. Auxiliary Ingredients

The detergent compositions of the present invention may further comprise one or more additional ingredients that provide additional cleaning and/or aesthetic benefits.

i. Hydrotropes

The concentrated detergent compositions of the present invention may optionally include a hydrotrope, used to keep the detergent products stable and prevent separation into multiple layers during storage. A preferred hydrotrope is sodium cumene sulfonate.

ii. Builders

Builders can also be employed in the compositions of the present invention. Detergent builders sequester calcium and magnesium hardness ions that might otherwise bind with and render the surfactants or optional cosurfactants less effective or ineffective. Builders are especially useful when auxiliary surfactants or optional cosurfactants are employed, and are even more useful when the compositions are diluted prior to use with exceptionally hard tap water. e.g., above about 12 grains/gallon. The detergent builders can be employed in the compositions of the present invention at concentrations of from about 0.001% to about 2.0% for concentrated detergent compositions, and at levels of from about 0.1 ppm to about 5.0 ppm for RTU detergent compositions.

iii. Thickening Agent

The concentrated detergent compositions of the present invention may optionally include a thickening agent to aid in the dispensing and proportioning of concentrated detergent compositions via standardly available dispensing and dilution equipment.

In one embodiment of the present invention the detergent composition's viscosity is used to help control how much product is proportioned to a washtub via a single application cycle of a detergent dispensing device. In a preferred embodiment the concentrated detergent is delivered to the sink via a water aspirator that dilutes the composition to the desired level (i.e., a proportioner). Water flowing through the proportioner generates a vacuum that pulls the composition into the flowing water, automatically providing dilution. Once the prescribed amount of water for the given dispensing device is flowing through the proportioner the level of vacuum pull will remain constant.

Once constant vacuum pull is achieved the amount of detergent flowing into the water stream is controlled by the size of the opening (i.e., the tip) to the concentrated composition and the viscosity of the composition. In practice, smaller openings will pull the detergent compositions more slowly, allowing greater proportioning control. However, smaller openings are highly susceptible to clogging. In contrast, larger openings are less susceptible to clogging, but are harder to control; i.e., product flow through the larger openings. Compositions with a higher viscosity will be pulled more slowly into the water flow, while less viscous detergent compositions will flow more rapidly.

A viscosity of from about 65 cps to about 75 cps is preferred for delivering about 264 grams of product to a 50-gallon wash tank, in the time it takes to fill the tank with water, through a 0.02032 cm–0.02286 cm opening in the dispensing tip. A tip with a diameter hole in excess of about 0.028 cm can be used to deliver the same volume of detergent by making the product thicker. However, this increases product cost because additional polymer is required. A tip with a diameter less than about 0.01524 cm can be utilized to deliver a volume of about 264 grams of detergent if the composition were less viscous. However, an increased risk of clogging is more probable.

A preferred thickening agent for use in the present invention is Acusol 810A®, manufactured by the Rohm and Haas Corporation of Philadelphia, Pa.

iv. Anti-Precipitation Agents

The concentrated detergent compositions of the present invention may optionally include an anti-precipitation agent. Suitable anti-precipitation agents will decrease or inhibit the precipitation of the present detergent composition components resulting from interactions with water of varying degrees of hardness, particularly thickening agents. A preferred anti-precipitation agent for use in the present invention is Acusol 445N®, manufactured by the Rohm and Haas Corporation of Philadelphia, Pa.

v. Other Ingredients

Other optional additives such as dyes, perfumes, salts, brighteners, enzymes, colorants, and the like can be employed in the compositions to enhance aesthetics and/or cleaning performance. These additives must be compatible with the active components in the composition, and they should not interfere with the sudsing and cleaning characteristics as discussed herein.

III. Methods of Use

The detergent compositions of the present invention may be used in accordance with conventional or otherwise known industrial dish washing methods and equipment to provide grease-cutting and cleaning benefits.

A preferred method for cleaning food and beverage preparation and serving utensils and equipment utilizes a non-enclosed automatic dishwasher of the type described herein. Such automatic dishwashers are commercially available under various trade names, are available with a variety of configurations, and automatically dispense and dilute the detergent compositions by adding tap water to the concentrated detergent composition. Preferred non-enclosed automatic dishwashers for use in the methods of the present invention are those that provide a dilution ratio in the range of about 1 part detergent to about 700 parts water to about 1 part detergent to about 1100 parts water. Particularly preferred non-enclosed automatic dishwashers for use in the methods of the present invention are those that provide a dilution ratio in the range of about 1 part detergent to about 800 parts water to about 1 part detergent to about 1000 parts water. Automatic dishwashers capable of providing a ratio of about 1:900 parts concentrated detergent composition to water is especially preferred.

In one embodiment of the present invention the resulting diluted composition comprises: a) from about 55 ppm to about 75 ppm of a surfactant; b) from about 45 ppm to about 75 ppm of an alkalinity source; c) from about 20 ppm to about 45 ppm of a hydrotrope; d) from about 0.1 ppm to about 5 ppm of a builder; and e) from about 5 ppm to about 18 ppm of a thickener.

In another preferred method, the concentrated detergent composition is first diluted with water at a ratio of about 1:900 parts concentrated detergent composition to water. The diluted composition comprises from about 55 ppm to about 75 ppm of the surfactant described herein. The diluted composition also comprises from about 45 ppm to about 75 ppm of an alkalinity source, from about 20 ppm to about 45 ppm of a hydrotrope, from about 0.1 ppm to about 5 ppm of a builder, and from about 5 ppm to about 18 ppm of a thickener, each of which are described herein. The diluted composition is then added to and utilized with a non-enclosed automatic dishwasher of the type disclosed herein.

IV. Methods of Making

In preparing the concentrated detergent compositions of the present invention it is important to make sure that any included thickening agent is able to swell at a rate that will inhibit the formation of insoluble polymer particles, typically forming insoluble "balls" that are incapable of being reprocessed by temperature, time or pH. Thickening agents are typically supplied in an acidic form that swells as they are neutralized.

Accordingly, the order of addition for components of the detergent compositions of the present invention is a function of the pH of the raw materials. Acidic materials are added first, followed by the neutral materials, and then the caustic or alkaline materials.

In one embodiment of the present invention a concentrated detergent composition is prepared comprising the ingredients of Table 2.

TABLE 2

| |
|---|
| Thickening Agent (Acusol 810 A) |
| Anti-Precipitation Agent (Acusol 445N) |
| Surfactant (Sodium Paraffin Sulfonate) |
| Hydrotrope (Sodium Cumene Sulfonate) |
| Dye (FD&C Yellow #5) |
| Builder (Sodium Ethylenediaminetetraacetic Acid) |
| Alkalinity Source (2-Amino-2-Methyl-1-Propanol & Sodium Hydroxide) |
| Perfume (Sunshine Perfume) |
| Balance of Water (ca. 70% of free water) |

The thickening agent (Acusol 810A) is first added to the water and the polymer is given a sufficient amount of time to relax and unfold in solution. The water and the thickening agent are then mixed for approximately 15–20 minutes before adding any other components. The neutral components, including the anti-precipitation agent (Acusol 445N), the surfactant (Sodium Paraffin Sulfonate), the hydrotrope (Sodium Cumene Sulfonate) and the dye (FD&C Yellow #5) are then added. The resulting solution is mixed for another 15–20 minutes. The builder (Sodium Ethylenediaminetetraacetic Acid) is then added in its entirety.

The caustic components are then added in stages. The alkalinity source (2-amino-2-methyl-1-propanol and sodium hydroxide) is divided into 3 equal portions for each alkalinity source used (i.e., 6 total additions in the present example). Each portion is added with 15 minutes of stirring between each addition. Finally, the perfume is added in its entirety.

This order of addition, in combination with the controlled addition of the caustic components in the presence of agitation, allows the detergent compositions to be prepared with the desired uniform viscosities.

V. EXAMPLES

The compositions illustrated in the following examples illustrate specific embodiments of the detergent compositions of the present invention, but are not intended to be limiting thereof. The skilled artisan can undertake other modifications without departing from the spirit and scope of this invention.

Example 1

The following examples illustrate a detergent composition with stable sudsing characteristics. The representative detergent composition is diluted to a ratio of about 1:900 parts concentrated cleaning composition to water when utilized in a non-enclosed automatic dishwasher of the type described herein.

| Formula Component | Concentrated Product % By Weight | 1:900 Dilution Parts per million | CAS Number |
|---|---|---|---|
| Thickening Agent (Acusol 810A) | 1.000 | 11.00 | Mixture |
| Anti-precipitation agent (Acusol 445N) | 0.750 | 8.50 | 9003-04-7 |
| Surfactant (sodium paraffin sulfonate) | 5.500 | 62.50 | 68608-26-4 |
| Hydrotrope (sodium cumene sulfonate) | 2.750 | 31.20 | 28348-53-0 |
| Dye (FD&C Yellow #5) | 0.003 | 0.03 | 1934-21-0 |
| Builder (sodium ethylenediminetetraacetic acid) | 0.045 | 0.51 | 64-02-8 |
| Alkalinity Source (2-amino-2-methyl-1-propanol) | 5.000 | 56.80 | 124-68-5 |
| Alkalinity Source (sodium hydroxide) | 0.500 | 4.50 | 1310-73-2 |
| Perfume (sunshine perfume) | 0.0825 | 0.94 | Mixture |
| Water | 84.370 | | |
| pH | 12.50 | 9.5–9.8 | |

The concentrated composition of Example 1 has a Brookfield viscosity of 70 cps±7 cps (70° F., LV, Spindle #1), and a specific gravity of 1.030 gms/ml.

Having now described several embodiments of the present invention it should be clear to those skilled in the art that the forgoing is illustrative only and not limiting, having been presented only by way of exemplification. Numerous other embodiments and modifications are contemplated as falling within the scope of the present invention as defined by the appended claims thereto.

We claim:

1. A concentrated detergent composition comprising:

a) from about 0.25% to about 10% of a surfactant; and b) from about 4% to about 8% of an alkalinity source, wherein the concentrated detergent composition has a pH in the range of from about 12 to about 13, and further wherein the concentrated detergent composition has a dilution ratio to water ranging from about 1 part detergent to about 700 parts of water to about 1 part detergent to about 1100 parts of water.

2. The concentrated detergent composition of claim 1 further comprising:

c) from about 0.1% to about 4.0% of a hydrotrope.

3. The concentrated detergent composition of claim 1 further comprising:

c) from about 0.001% to about 2.0% of a builder.

4. The concentrated detergent composition of claim 1 further comprising:

c) from about 0.01% to about 3.0% of a thickener.

5. The concentrated detergent composition of claim 1 further comprising:

c) from about 0.1% to about 4.0% of a hydrotrope; and d) from about 0.001% to about 2.0% of a builder.

6. The concentrated detergent composition of claim 5 further comprising:

e) from about 0.01% to about 3.0% of a thickener; and f) an additional component selected form the group consisting of dyes, perfumes, salts, brighteners, enzymes, colorants, and mixtures thereof, wherein the concentrated detergent composition has a pH in the range of from about 12.40 to about 12.60.

7. The concentrated detergent composition of claim 6 wherein said alkalinity source is selected from the group consisting of sodium carbonate, sodium metasilicate, 2-amino-2methyl-1-propanol, sodium hydroxide, and mixtures thereof.

8. The concentrated detergent composition of claim 7 wherein said alkalinity source is a blend of two or more different alkalinity sources selected from the group consisting of sodium carbonate, sodium metasilicate, 2-amino-2methyl-1-propanol, sodium hydroxide, and mixtures thereof.

9. The concentrated detergent composition of claim 7 further comprising:

g) an anti-precipitation agent, wherein said hydrotrope is sodium cumene sulfonate.

10. A diluted detergent composition comprising:

a) from about 50 ppm to about 80 ppm of a surfactant, and b) from about 45 ppm to about 75 ppm of an alkalinity source, wherein the diluted detergent composition has a pH in the range of from about 7 to about 11.

11. The diluted detergent composition of claim 10 further comprising:

c) from about 20 ppm to about 45 ppm of a hydrotrope.

12. The diluted detergent composition of claim 10 further comprising:

c) from about 0.1 ppm to about 5 ppm of a builder.

13. The diluted detergent composition of claim 10 further comprising:

c) from about 5 ppm to about 18 ppm of a thickener.

14. The diluted detergent composition of claim 10 further comprising:

c) from about 20 ppm to about 45 ppm of a hydrotrope;

d) from about 0.1 ppm to about 5 ppm of a builder;

e) from about 5 ppm to about 18 ppm of a thickener; and f) an additional component selected form the group consisting of dyes, perfumes, salts, brighteners, enzymes, colorants, and mixtures thereof, wherein the diluted detergent composition has a pH in the range of 9 to about 10.

15. The diluted detergent composition of claim 14 wherein said alkalinity source is selected from the group consisting of sodium carbonate, sodium metasilicate, 2-amino-2methyl-1-propanol, sodium hydroxide, and mixtures thereof.

16. The diluted detergent composition of claim 15 wherein said alkalinity source is a blend of two or more different alkalinity sources selected from the group consisting of sodium carbonate, sodium metasilicate, 2-amino-2methyl-1-propanol, sodium hydroxide, and mixtures thereof.

17. The diluted detergent composition of claim 14 further comprising:

g) an anti-precipitation agent, wherein said hydrotrope is sodium cumene sulfonate.

* * * * *